United States Patent [19]

Jaqua

[11] 4,281,582

[45] Aug. 4, 1981

[54] CONTROL PISTON FOR LIQUID PROPELLANT GUN INJECTOR

[75] Inventor: Vance W. Jaqua, Canoga Park, Calif.

[73] Assignee: The United States of America as represented by the Secretary of the Air Force, Washington, D.C.

[21] Appl. No.: 50,274

[22] Filed: Jun. 19, 1979

[51] Int. Cl.[3] ..... F41F 1/04

[52] U.S. Cl. ..... 89/7

[58] Field of Search ..... 89/7, 11, 1 R

[56] References Cited

U.S. PATENT DOCUMENTS

| | | | |
|---|---|---|---|
| 3,138,990 | 6/1964 | Jukes et al. | 89/7 |
| 3,763,739 | 10/1973 | Tassie | 89/7 |
| 4,043,248 | 8/1977 | Bulman et al. | 89/7 X |
| 4,050,348 | 9/1977 | Graham | 89/7 |
| 4,099,445 | 7/1978 | Singelmann et al. | 89/7 |
| 4,100,836 | 7/1978 | Hofmann | 89/7 |
| 4,126,078 | 11/1978 | Ashley | 89/7 |
| 4,160,405 | 7/1979 | Ayler et al. | 89/7 |

*Primary Examiner*—David H. Brown

*Attorney, Agent, or Firm*—Donald J. Singer; Robert Kern Duncan

[57] ABSTRACT

The injection piston of a regenerative liquid propellant gun is attached to a second piston that has a programmed hydraulic resistance which controls its motion, thus the propellant injection rate from the injection piston and the burning rate of the injected propellants is controlled to provide better propellant pressure-time burning characteristics.

1 Claim, 3 Drawing Figures

CONTROL PISTON FOR LIQUID PROPELLANT GUN INJECTOR

RIGHTS OF THE GOVERNMENT

The invention described herein may be manufactured and used by or for the Government of the United States for all governmental purposes without the payment of any royalty.

BACKGROUND OF THE INVENTION

To understand the operation of the novel damper piston of this invention, it may be helpful to briefly review the functioning of the conventional, prior art, regenerative feed system in liquid propellant guns. The regenerative feed system is basically a pressure intensifier or pressure amplifier in principle where the combustion chamber face of the system has a significantly greater area than the hydraulic face area of the propellant injection piston sections. Thus, an increase in combustion chamber pressure will be reflected by a greater increase in propellant injection pressure causing the propellants to spray into the chamber as the piston is forced rearward by the combustion chamber pressure. The injection flow rate is primarily a function of velocity of the piston assembly.

The most applicable known prior art is that exemplified by U.S. Pat. No. 4,050,348 to patentee Graham. U.S. Pat. Nos. 3,803,975, 4,033,224, and 4,050,349 to patentees Elmore et al., Holtrop and Graham, respectively, may also be of interest.

SUMMARY OF THE INVENTION

The invention comprises a control piston that is rigidly attached or structurally integral with the propellant injection piston. The control piston controls, in a predetermined manner, the velocity and rate of change of velocity of the injection piston and therefore controls the rate of propellant injection and the combustion chamber pressure characteristics. The control piston has both a programmed movement control and a static force applying system.

DESCRIPTION OF THE PREFERRED EMBODIMENTS

Figure 1:
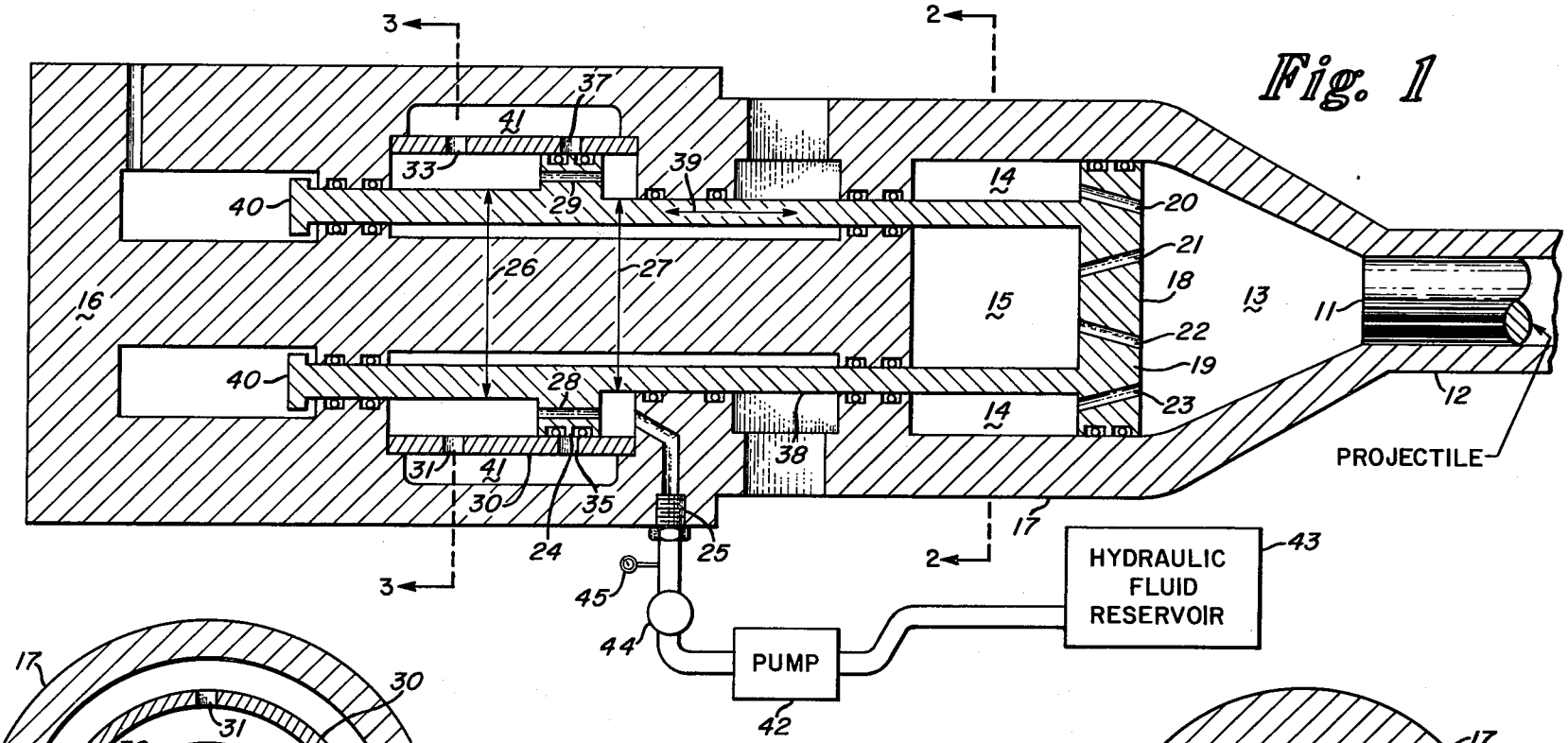
FIG. 1 is a schematic longitudinal section view of an embodiment of the invention.
Figure 2:
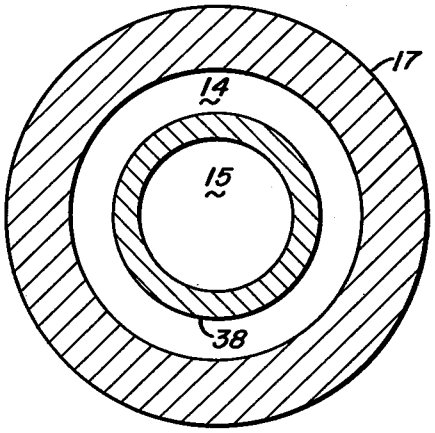
FIG. 2 is a schematic transverse section view of the embodiment illustrated in FIG. 1 taken at the position represented in FIG. 1 by 2—2.
Figure 3:
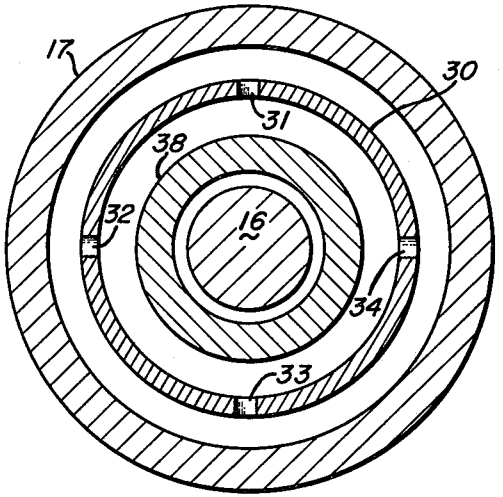
FIG. 3 is a schematic transverse section view of the embodiment illustrated in FIG. 1 taken at the position represented in FIG. 1 by 3—3.

Referring to FIG. 1, which schematically represents a longitudinal section of a liquid propellant gun containing a typical embodiment of the invention, the projectile 11 is forced down the gun barrel 12 by the burning of the liquid propellant in the combustion chamber 13. Oxidizer charge chamber 14 and fuel charge chamber 15 (see also FIG. 2) are charged in the conventional manner. Generally, the fuel lines extend from connections at the end of the breech plug 16 through the core of the breech plug to the chamber 15, and the oxidizer inlets are generally through the wall 17 directly into charging chamber 14. These features and the control of the propellants into the charging and combustion chambers are conventional, not a part of the present invention, and hence not illustrated. The details of the assembly of the gun structure, such as the fastening of the breech plug to the gun receiver 17, also are conventional and omitted from the drawing.

The pressure generated in the combustion chamber 13 creates a rearward force on the combustion face 18 of the piston 19. The combustion face 18 of the piston has a significantly greater area than the hydraulic face area of the piston in the charge chambers 14 and 15. Thus, an increase in combustion chamber pressure will be reflected by a greater increase in the propellant injection pressure in chambers 14 and 15 causing the propellants to spray into the combustion chamber 13 through the conventional orifice passageways 20, 21, 22, and 23, in the piston head. As previously stated, the injection flow rate into the combustion chamber is primarily a function of the velocity of the rearward travel of the piston 19. It is the control of this piston movement that is an object of this invention.

By mechanically attaching the injection piston 19 to a second piston 24 and providing control of the hydraulic resistance to the motion of this second piston, control of the flow of the propellant from the charge chambers 14 and 15 to the combustion chamber 13 is provided. This programmed hydraulic resistance may be provided by any of several method, i.e., tapered metering rods, by-pass passages and ports, specially configured orifices, etc. A very satisfactory and generally preferred system for controlling the control piston is schematically illustrated by the drawing. A static hydraulic force, conventional hydraulic fluid and pump may be used, is applied by pressurizing the control piston cavity through the inlet port 25. This is accomplished by the conventional hydraulic pump 42 pumping the hydraulic fluid from the reservoir 43. Conventional pressure control valve 44 and gage 45 may be used to set the desired operating pressure. The two piston shanks at each side of the piston head 24, are two different diameters. Diameter 26 is greater than diameter 27, thus pressurizing the cavity will provide a net rearward force relative to the area included between diameter 26 and diameter 27 and the fluid pressure. That is, since the effective face area of the control piston on the side adjacent the fluid inlet is larger than the effective face area on the back side of the control piston, the piston will move rearward. In this embodiment the configuration of the control piston will keep the injection piston retracted against maneuvering loads, as well as provide resistance against the filling of the propellant cavity and provide a force to start injection from the extended piston position (with a full load of propellants). Under dynamic conditions, with the pistons moving, the control forces on the control piston are related to the piston velocity and the flow area through the various by-pass orifices. The piston head 24 is drilled through to provide fixed area orifices 28 and 29 from the front face to the rear face of the piston. The outer bore of the control cylinder is a replaceable sleeve 30 with rear ports 31, 32, 33, and 34, and front ports 35 and 37. These ports are opened and closed by the position of the control piston 24 as it is moved over the length of its throw. Since the control piston 24 and the injection piston 19 are rigidly attached to each other by the hollow cylindrical connecting member 38, the magnitude of travel 39 of the pistons is limited in the forward direction by the stop flange 40 and in the rearward direction by the piston 19 exhausting the charge chamber cavities and seating against the rearward surfaces of the charging chambers. When the control piston 24 is at the right end of its travel, flow between the two sides of the piston is limited to the small fixed orifices 28 and 29 since the by-pass flow through ports 35 and 37 is blocked by being covered by the piston 24. The piston 24 will thus see a large restricting force until the piston uncovers the ports 35 and 37 and permits fluid to flow from ports 31–34 through the by-pass 41 and ports 35 and 37 allowing the piston to move freely and rapidly. When the piston travels far enough to cover the ports 31–34 the flow restriction of the fixed orifices 28 and 29 becomes effective again, and the piston travel velocity is retarded before it "bottoms" out, thus, greatly reducing the "banging" of the piston 19 against the charging chamber rear walls.

With the control piston programmed as illustrated in an embodiment of the invention, as previously described, it provides a gradual buildup of combustion pressure in the gun chamber 13 initially, followed by a rapid buildup when the ports are uncovered. This provides for reduced back blast from the anti-recoil nozzle while providing a rapid pressure rise to drive the projectile 11 out the barrel 12. The control piston also provides a "snubbing" effect, as previously stated, at the end of the piston travel to avoid hardware damage. The differential area of the control piston, i.e., the difference in area at diameter 26 and at diameter 27, controls the charging pressure generated by the propellant piston 19 by providing a retarding force proportional to the pressure of the control or damper piston fluid times this differential area. This is especially important in loading high vapor pressure propellants to assure total liquid filling of the propellant volume. Increasing the damper fluid pressure will tend to, and eventually, pull the propellant piston back, initiating the propellant injection for the firing cycle. This rearward force will also hold the propellant piston in the retracted "ready" position between shots avoiding undesired piston movement under acceleration forces or abnormal attitudes of the gun.

Those practicing this invention will readily adjust the parameters of piston areas, fixed orifice areas, programmed port areas, and control fluid viscosity and pressure to provide the desired "shape" of the pressure-time relationship in the liquid propellant gun combustion chamber, all within the scope of the invention.

I claim:

1. The improvement in a regenerative feed liquid propellant gun having a propellant injection piston and a charge chamber, said improvements for controlling the movement of the said injection piston, comprising:

a. a control piston having a first face with a first effective pressure area and a second face with a second effective pressure area;

b. means for rigidly attaching said control piston to said propellant injection piston;

c. means for applying hydraulic fluid under pressure to the first face of the said control piston;

d. means providing a fixed orifice through said control piston from said first face to said second face for providing a determined flow of hydraulic fluid therethrough;

e. a cylindrical sleeve cooperating with said control piston, said cylindrical sleeve having spaced apart ports opening to the first and second faces of said control piston; and f. means cooperating with said ports to provide a by-pass passage for the flow of hydraulic fluid; and g. means moving said control piston relative to said ports for restricting the flow of hydraulic fluid through said by-pass passage to vary the resistance to the movement of said control piston.

* * * * *